US009243455B2

(12) United States Patent
Angelici

(10) Patent No.: US 9,243,455 B2
(45) Date of Patent: Jan. 26, 2016

(54) METHODS FOR DIRECTING VERTICAL DRILLING

(75) Inventor: Marco Angelici, Perugia (IT)

(73) Assignee: TREVI S.p.A., Cesena, Forlì-Cesena (IT)

( * ) Notice: Subject to any disclaimer, the term of this patent is extended or adjusted under 35 U.S.C. 154(b) by 813 days.

(21) Appl. No.: 13/547,083

(22) Filed: Jul. 12, 2012

(65) Prior Publication Data

US 2013/0020129 A1 Jan. 24, 2013

(30) Foreign Application Priority Data

Jul. 22, 2011 (IT) ..... TO2011A0660

(51) Int. Cl.
*E21B 7/10* (2006.01)
*E21B 47/022* (2012.01)
*E21B 7/06* (2006.01)

(52) U.S. Cl.
CPC . *E21B 7/10* (2013.01); *E21B 7/067* (2013.01); *E21B 47/022* (2013.01)

(58) Field of Classification Search
CPC ..... E21B 7/10; E21B 7/06; E21B 7/067; E21B 47/022
See application file for complete search history.

(56) References Cited

U.S. PATENT DOCUMENTS 4,909,336 A * 3/1990 Brown et al. ..... E21B 47/022 175/45
7,287,606 B1 10/2007 Falgout, Sr.
2003/0236627 A1 12/2003 Estes

FOREIGN PATENT DOCUMENTS

EP 1514996 A1 3/2005
GB 2321970 A 8/1998

* cited by examiner

*Primary Examiner* — Brad Harcourt
*Assistant Examiner* — Wei Wang
(74) *Attorney, Agent, or Firm* — Robert E. Alderson, Jr.

(57) ABSTRACT

Methods allowing precise directional drilling are provided. Such methods include use of directional drilling equipment which include a drill string with a hollow bottom rod connected to a boring tool by means of an obtuse-angle connection piece or "bent sub". In order to restore the verticality of the drilling a vertical borehole section (F) is formed and then a probe equipped with an inclinometer is lowered inside the bottom rod. The string may be rotated into four angular positions and the inclination values of the probe in each angular position are detected at the depth reached. The string is rotated so as to bring it into an angular position corresponding to the maximum inclination value detected. The string is moved so as to move the boring tool further downwards and the inclination of the probe is detected again in order to check that verticality has been reached.

11 Claims, 3 Drawing Sheets

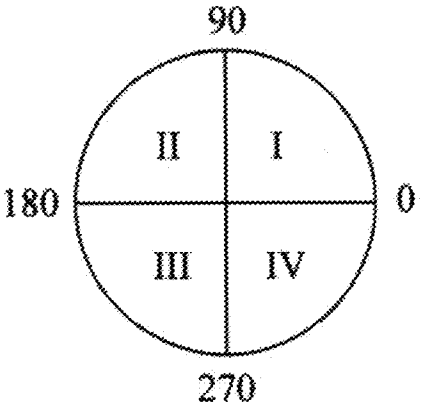
FIG.5
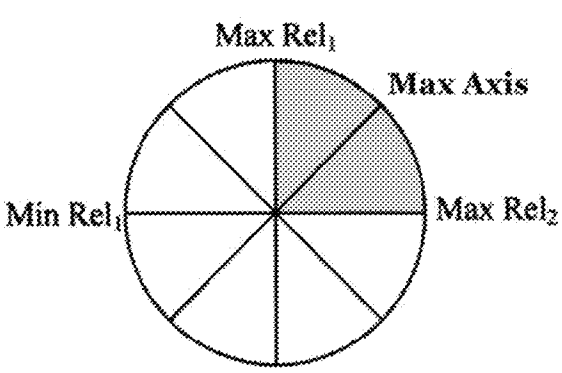
FIG.6
FIG.7
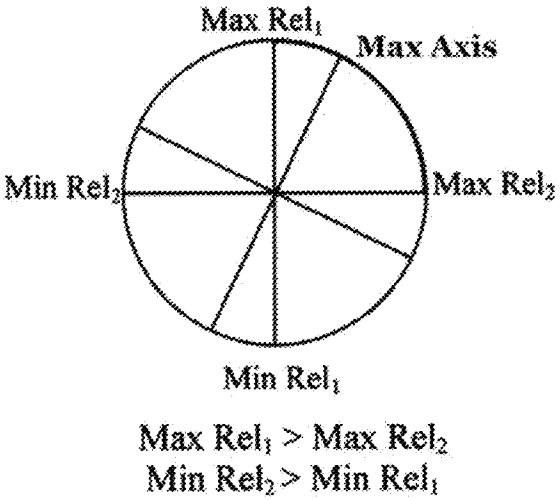
FIG.8

METHODS FOR DIRECTING VERTICAL DRILLING

CROSS REFERENCE TO RELATED APPLICATION

This application claims priority to and benefit of Italian Patent Application No. TO2011A000660 filed Jul. 22, 2011, the contents of which are incorporated by reference in their entirety.

FIELD OF THE INVENTION

The present invention relates to methods for directing vertical drilling.

BACKGROUND OF THE INVENTION

Higher precision equipment used hitherto for vertical drillings includes equipment which makes use of an inclinometer (typically a triaxial accelerometer) associated with a compass (triaxial magnetometer). Inclinometer and compass are usually contained in a special rod forming a so-called down-hole assembly (or unit). As is known, the inclinometer provides the value of the inclination with respect to the vertical, while the compass indicates the azimuthal angle of the direction containing this inclination.

In order to reposition drilling in its nominal direction, and therefore restore the verticality of the borehole, a deviation must be imparted to the tool in the opposite direction to that of the inclination detected. For this purpose, in order to correct the direction of the drilling, i.e. deviate it, the tool is connected to the drill string by means of a deviation connecting member in the form of an elbow sleeve, referred to in the sector as "bent sub". The bent sub is arranged between the tool and the string so that the axis of the tool is angularly offset by a few degrees (generally 1 to 3 degrees) with respect to the axis of the drill string.

Hitherto, in order to determine the azimuthal direction in which the so-called tool face must be oriented in order to restore the verticality of the excavation, the information made available by the compass is used. In order to orient correctly the directional tool, it is therefore indispensable for the compass to indicate the right direction. However, the compass does not always function correctly; this may be due to magnetic disturbances induced by metallic bodies or by electric currents flowing in the vicinity of the drilling.

Moreover, with the excavation equipment which is most widely used, the compass may not be permanently contained inside the special tool-holder rod (usually a nonmagnetic stainless-steel rod), but must be lowered to the bottom of the excavation whenever a measurement is performed and then removed in order to start the drilling again. Consequently, the correct orientation of the compass with respect to the bent sub and the boring tool is not always readily obtainable. In particular, on each occasion the compass must be removed and repositioned with great accuracy. The instrument must be locked angularly in a given fixed angular position with respect to the elbow of the bent sub. For this purpose it is necessary to use a guiding and connection device called a "mule shoe" which is lowered inside the down-hole assembly. The mule shoe guides the compass into the correct angular position and prevents it from rotating with respect to the tool bit.

It is indispensable to remove the instrument in particular if boring is performed by means of a hydraulic hammer. This type of tool, which is particularly effective, in fact produces impacts and vibrations which rapidly destroy the compass if it is not removed from the string. Moreover, the high pressures which are required for operation of the hammer may result in the infiltration of water into the data supply/transmission line of the instrument itself.

The orientation of the bent sub in the correct direction may therefore be difficult or, in some situations, even impossible. The precision of the drilling, and therefore the need to correct deviations from the vertical, is of fundamental importance in many applications, for example in the construction of partitions at a depth of more than 40 meters, consisting of posts which are arranged alongside one another and which must overlap by a few centimeters (2-3 cm) in order to ensure the continuity and the impermeability of construction work.

The abovementioned method moreover requires that the compass sensors should be arranged very close to the elbow in order to detect with a high degree of accuracy the inclination and orientation of the bent sub. Owing to this proximity, the compass is affected by the magnetic disturbances of the hammer body. The angular data made available by the compass (through a method known as "magnetic tool face orientation", MTFO) therefore may not be used during orientation of the tool face. Therefore, although in the calculation of the spatial position of the tool face, the compass error is within acceptable limits and may be corrected by means of several readings, for an evaluation of the orientation of the tool face it is necessary to resort to a method which is not subject to major errors so as to be able to correct the deviation in the shortest possible vertical space and with the maximum efficiency.

SUMMARY OF THE INVENTION

A general object of the present invention, therefore, is to perform precise directional drilling. A particular object of the invention is to propose a directional drilling method which allows orientation of the tool with a sequence of rapid operations. A further object is to calculate with precision the position of the bottom of the hole. Another particular object of the invention is to perform precise directional drillings using a hydraulic hammer.

This object, together with other objects and advantages, which will be understood more clearly from a reading of the ensuing description, is achieved according to the invention by a method which includes the operating steps defined in the accompanying claims.

BRIEF DESCRIPTION OF THE FIGURES

A preferred, but non-limiting embodiment of the method according to the invention will now be described with reference to the accompanying drawings, in which:

FIGS. 1-4 are schematic vertically sectioned views of a down-hole assembly of a drilling apparatus, shown in different operating positions during execution of methods according to the invention.

FIGS. 1A-4A are schematic top plan views of the assembly shown in FIGS. 1-4.

FIGS. 5-8 are diagrams showing angular positions of a boring tool of the apparatus shown in FIGS. 1-4.

DETAILED DESCRIPTION

Figures 1, 1A, 2, 2A, 3, 3A, 4, 4A:
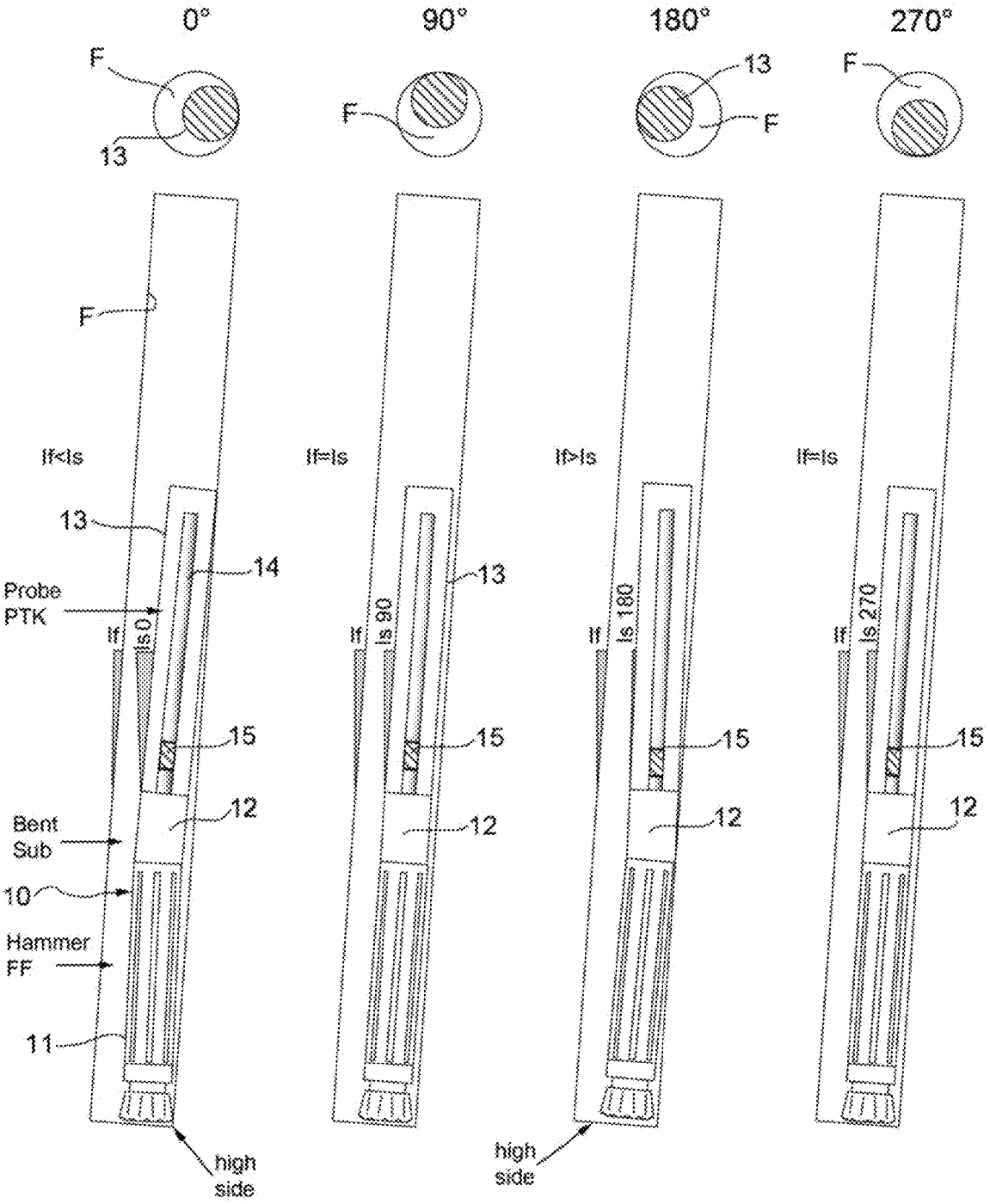

With reference to FIGS. 1 to 4, these show four different angular positions, angularly offset or rotated through 90°, of a down-hole assembly 10. The assembly 10 is located at the bottom of a borehole F which is inclined at an angle If with respect to the vertical. The assembly 10 comprises a boring tool 11 consisting, advantageously, of a hydraulic hammer. The choice of this type of tool is not to be regarded as limiting the invention; the invention is suitable for being implemented also using other types of boring tools. One of the main advantages provided by the invention consists, however, in the possibility of also using this particularly effective tool, i.e. the hydraulic hammer, for performing directional drilling into hard deep-lying rock.

The down-hole assembly 10 comprises a bent sub 12 which rigidly connects the boring tool 11 to the hollow bottom rod 13 of the drill string. A probe 14, for example, a tracing or guide sensor or probe, such as Paratrack® or PTK, is lowered into the internal cavity of the bottom rod 13. Both the probe and the bent sub and the hydraulic hammer are known in the art and do not need to be described in detail here. It should merely be pointed out that the probe 14 may consist of any instrument containing an inclinometer and a compass indicated schematically by 15 in FIGS. 1-4. Preferably, the compass is a triaxial magnetometer of the type already used per se in the sector of directional drilling. The bent sub generally has an elbow defining an obtuse angle generally ranging between 177 and 179 degrees.

According to methods of the present invention, in order to correct directional errors during drilling, it is periodically necessary to stop drilling at different depths and perform, at each depth level reached, a plurality (in this case four) of recordings in order to measure the inclination of the probe in each of the four angular positions rotated through 90°. The object of these measurements is to:

calculate the local inclination i of the hole and its orientation in the azimuthal plane xy;

determine, at least approximately, the direction or at least the segment or quadrant into which the so-called "tool face" must be oriented in order to correct the inclination and reposition drilling vertically.

In the drilling sector, the expression "tool face" indicates a point on the periphery of the bottom end situated on the concave side of the bent sub; more particularly, the "tool face" is the side lying in that plane which passes through the longitudinal axis of the hammer and which defines a minimum obtuse angle between the longitudinal axis of the hammer and the longitudinal axis of the drill string. In other words, the "tool face" is the part or side of the tool which must be directed upwards in order to raise drilling upwards.

Once a borehole section has been completed, drilling is stopped and the probe 14 is lowered inside the hollow bottom rod 13. The value of the inclination $Is_0$ is measured and then the string is rotated (without moving it further downwards) through 90°, and measurement of the inclination is repeated, obtaining the inclination value $Is_{90}$. This operation is repeated a further two times, rotating the string each time through 90° and measuring the inclination, thus obtaining the inclination values $Is_{180}$ and $Is_{270}$. The values detected are obtained, in each angular position, from the algebraic sum of the inclination If of the hole and the inclination Is of the probe. The inclination If of the hole is constant for each measurement performed at the same depth, while the inclination of the probe varies, when the string is rotated, owing to the fold in the bent sub. Still with reference to FIGS. 1-4, during the analysis of the inclinations the following are recorded:

1. a maximum value (0° position)
2. two intermediate values (90° and 270° positions) and
3. a minimum value (180° position).

In the example shown in FIGS. 1-4, the angular position of FIG. 1 is that in which the inclination of the tool is maximum. In the "0°" and "180°" positions, the inclination recorded by the inclinometer is greater than or smaller than, respectively, the real inclination If of the hole. This is due to the asymmetry induced by the bent sub. The arithmetic average of the values $Is_0$, $Is_{90}$, $Is_{180}$ and $Is_{220}$ gives, as a result, the real inclination If of the hole. When calculating the average, the values of the angles $Is_0$, $Is_{90}$, $Is_{180}$ and $Is_{270}$ compensate each other.

The maximum inclination value detected from among the values $Is_0$, $Is_{90}$, $Is_{180}$ and $Is_{220}$ indicates, in the azimuthal plane, the quadrant in which the tool face is located.

In order to restore the verticality, first the string is rotated, without causing it to move vertically, in such a way as to direct it into the angular position which indicates the maximum inclination value, which in this example is the position 0. In the example shown in FIGS. 1-4 the angular position at 0° is the "absolute maximum inclination" position.

FIGS. 6, 7 and 8 show other possible situations. With reference to the quadrants and the angular positions indicated in the diagram of FIG. 5, the situation shown in FIG. 6 refers to an example where the absolute maximum value is detected in the 90° position, while in the 270° position, the minimum value is measured, and in the 180° and 0° positions two intermediate values are measured. FIG. 7 refers to an example where two maximum values which are practically equal are measured at 0° and 90°, so that the absolute maximum value will be situated at the halfway point of the quadrant I (at about 45°). In the example shown in FIG. 8, the maximum value is measured at 90° and the minimum value at 270°; since the intermediate value measured at 0° is slightly greater than the (lesser intermediate) value measured at 180°, the absolute maximum value will be situated at the halfway point of quadrant I, in an angular position closer to 90° than to 0°.

In the following, the expression "selected angular position" is used to designate either the angular position taken by the drill string when the maximum inclination value is detected, or an angular position between two angular positions at which two maximum inclination values have been detected.

Once the drill string has been rotated so as to reach the selected angular position, the instrument 14 including compass 15 is extracted from the string and the boring tool is then made to penetrate or sink into the ground a short distance, i.e. about a few tens of centimeters, without rotation of the drill string. This feeding movement is performed by imparting to the string small rotary reciprocations in the so-called "twist" mode, oscillating about the selected angular orientation position (in this example the position shown in FIG. 1). Owing to the angle of the bent sub, as is known to those skilled in the art, driving of the tool kept with its tool face directed downwards (FIG. 1) causes it to penetrate in such a way as to reduce its inclination and bring it back into alignment with the vertical. Twist mode feeding, per se known, may be carried out either manually by using a joystick for controlling rotation of the drill string or, as an alternative, by activating an automatic control which automatically inverts the flux of the hydraulic drive that causes the string to rotate, making it undergo reciprocating oscillations having a constant amplitude generally between about 20 and about 40 degrees.

After advancing along the abovementioned short section in twist mode, the tool is in a sunken position, with the drill string still approximately orientated in the aforesaid selected angular position. At this point, the instrument 14, 15 is lowered again into the down-hole assembly and the inclination of the hole is detected again in order to check whether, following the aforementioned corrective operation, the verticality has been restored. If this is the case, should the inclinometer signal a condition of verticality or at least an inclination suitable for the particular requirements, rotation of the string is activated again in order to continue drilling. If this is not the case, the sequence of verticality correction operations described above is repeated (detection of the inclination values in four equally spaced angular positions, orientation of the string in the maximum inclination position, feeding in twist mode).

Advancement of the tool in the twist mode is optional. According to additional embodiments of the present invention, if the tool is a hammer, the tool may be advanced causing the hammer to follow percussive motions, without rotating the drill string. If the boring tool is associated with a mud motor, the tool may be advanced by activating the mud motor without rotating the drill string. In either case, upon reaching the lowered or sunken position, the string is oriented in the aforesaid selected angular position.

The proximity of the inclinometer to the drilling face is important in order to achieve a high degree of precision. The greater the proximity to the face, the greater will be the capacity to measure precisely any deviations thereof. For this reason, in order to perform the drilling of rock, where a particularly high precision is required, mud motors tend not to be used since this type of tool has a considerable length (generally greater than 3.5 m, but greater than 4.5 m in the case of diameters of more than 4"). By using a down-hole hammer together with a bent sub it is possible to drastically reduce this length. A hydraulic (air or water) hammer able to make a 6" hole measures about 1 m.

As can be understood, with methods according to the present invention, it is possible to correct the direction of the excavation, restoring its verticality, practically in any conditions and for any initial inclination. It may be applied to any instrument equipped with an inclinometer. It is not affected by interference due to the Earth's magnetic field. It is not affected by the drilling length and therefore may be applied also to drillings performed in the mineral sector. In order to implement such methods, a conventional "mule shoe" connection is not required, since the tool face may be suitably directed in order to restore the verticality of the drilling independently of operation of the compass.

Correction of the verticality is therefore performed without use of the compass 15. The compass is used instead to determine the instantaneous spatial position reached by the boring tool face. This operation may, however, also be performed without being negatively affected by magnetic disturbances which are the cause of measurement errors in conventional operating methods.

The directional drilling method which uses a bent sub associated with a down-hole hammer poses two types of problems:

A) problems associated with the asymmetrical form of the assembly, on account of the angle of the bent sub, which results in falsification of the inclinometric and azimuthal measurements;

B) problems associated with magnetic disturbance induced by the metallic mass of the down-hole hammer which results in false angular values;

B') in the azimuths (i.e. in the angular value of the direction of the hole projected in the azimuthal plane xy);

B") in the magnetic orientation of the tool face: MTFO (magnetic tool face orientation).

The first type of problem (A) is solved as a result of the readings carried out of the inclination and azimuth values according to the algorithm shown further below. With respect to the problems associated with magnetic disturbances, the definition of the correct azimuth (B') is solved by means of symmetrical compensation of the azimuth readings according to the algorithm shown further below and, (B"), (definition of the correct tool face orientation-TFO) by means of the method described above which defines the Absolute Maximum Inclination.

The problem (A) of identifying the correct inclination is associated with the bending effect of the bent sub, which falsifies the values of the inclination (FIGS. 1-4) and the azimuth of the down-hole assembly 10.

For this reason a system for averaging the adjacent readings, based on the following algorithm for calculating the offset value of the rod end and consequently the position of the tool face along the axes x, y and z, is proposed.

Figure 9:
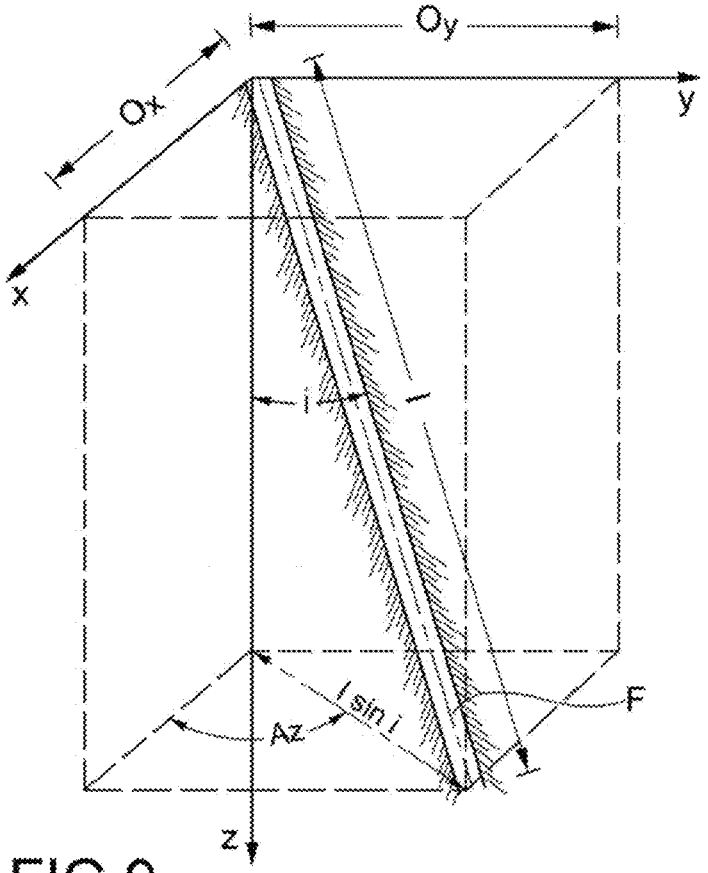
FIGS. 9, 10 and 11 are schematic views of a borehole section, with an indication of the parameters used by an algorithm proposed for calculation of the position of the bottom of the borehole.
Figure 11:
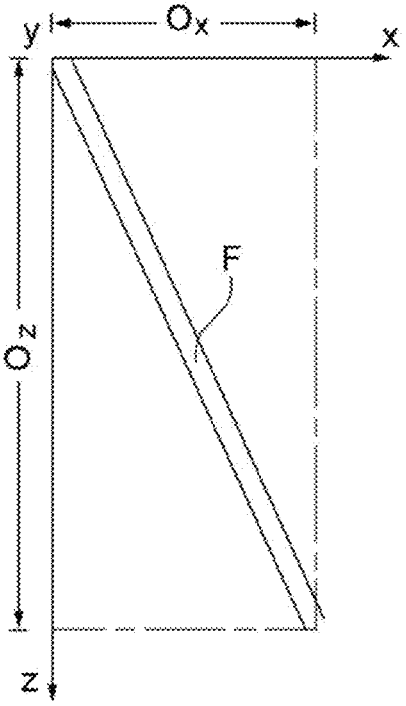
Figure 10:
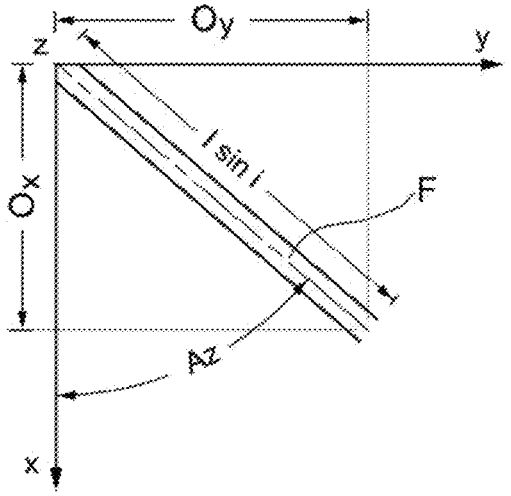

Assuming that:

$I_0, I_{90}, I_{180}, I_{270}$ are the inclination values detected for the four positions of the string, angularly equally spaced at 90°;

$Az_0, Az_{90}, Az_{180}, Az_{270}$ are the azimuth values detected by means of the compass 15, in the four abovementioned angular positions;

l=length of the drilled section (FIG. 9);

Oy is the offset value of the tool face along the y axis or "away axis" (this is a horizontal geometrical axis along the drilling direction);

Ox is the offset value of the tool face along the x axis or "right axis" (this is a horizontal axis perpendicular to the y axis);

Oz is the offset value of the tool face along the z axis or "elevation axis", which in the present example is equal to the depth reached.

$i_{m1}=(I_0+I_{90})/2$ the average of the values $I_0$ and $I_{90}$ $i_{m2}=(I_{180}+I_{270})/2$ the average of the values $I_{180}$ and $I_{270}$ if the difference $(Az_0-Az_{90})>180$ and if $((Az_0-Az_{90})/2)-180<0$, then:

$Az_{m1}=((Az_0+Az_{90})/2)+180$ if the difference $(Az_0-Az_{90})>180$ but $((Az_0-Az_{90})/2)-180>=0$, then:

$Az_{m1}=((Az_0+Az_{90})/2)-180$ if the difference $(Az_0-Az_{90})<=180$ $Az_{m1}=(Az_0+Az_{90})/2$ namely the average of the two values $Az_{180}$ and $Az_{270}$ In order to obtain the result:

$Ox=(Ox_1+Ox_2)/2$ namely the average of the offset values calculated using the two averages obtained from the average angular values $i_{m1}$ and $Az_{m1}$ $Oy=(Oy_1+Oy_2)/2$ namely the average of the offset values calculated using the two averages obtained from the average angular values $i_{m2}$ and $Az_{m2}$ where:

$$Ox_1=1\cdot\sin(i_{m1})\cdot\cos(Az_{m1})$$

$$Ox_2=1\cdot\sin(i_{m2})\cdot\cos(Az_{m2})$$

$$Oy_1=1\cdot\sin(i_{m1})\cdot\sin(Az_{m1})$$

$$Oy_2=1\cdot\sin(i_{m2})\cdot\sin(Az_{m2})$$

It is understood that the invention is not limited to the embodiments described and illustrated here. Such embodiments should be regarded as examples of the invention. The invention may be subject to modifications in terms of forms, dimensions, arrangement of parts, constructional details and apparatus used. For example, the number of measurements of the inclination at the same height, and therefore the angle between the various measurement positions, can differ from that shown here.

The invention claimed is:

1. A method for directing vertical drilling performed by means of directional drilling equipment, the equipment comprising:

a drill string at the bottom end of which a hollow bottom rod defining a first longitudinal axis is mounted;

a down-hole assembly including a boring tool defining a second longitudinal axis and a rigid connector bent at an obtuse angle or bent sub which rigidly connects the tool to the bottom rod such that the first and the second axes form a predetermined obtuse angle;

wherein said method comprises the following steps for restoring verticality of the drilling:

a) drilling a substantially vertical borehole section by means of said equipment;

b) stopping the movement of the string upon reaching a predetermined drilling depth;

c) lowering a probe equipped with an inclinometer into the hollow bottom rod;

d) keeping the drill string at said reached drilling depth, performing the following steps d1)-d5):

d1) detecting, by means of the inclinometer, the value ($I_0$) of the inclination of the probe with respect to the vertical in a first angular position;

d2) rotating the string around its longitudinal axis to a second angular position;

d3) detecting, by means of the inclinometer, the value ($I_{90}$) of the inclination of the probe with respect to the vertical in the second angular position;

d4) repeating steps d2) and d3) so as to obtain further inclination values ($I_{180}$, $I_{270}$) of the probe in other angularly spaced positions around the axis of the string;

d5) rotating the string so as to bring it into a selected angular position corresponding to the maximum inclination value detected, or into an intermediate angular position between the angular positions at which two maximum inclination values were detected;

e) causing the boring tool to advance further down, bringing the tool to a sunken position, with the drill string approximately orientated in said selected angular position;

f) interrupting the downward advancing motion of the tool and detecting again the inclination value given by the inclinometer;

g) obtaining, by means of the drilling equipment, a subsequent substantially vertical borehole section; and h) repeating steps b) to g).

2. The method of claim 1, wherein the angular positions are angularly equally spaced.

3. The method of claim 2, wherein the angular positions are angularly equally spaced at an angle which is a factor of 360°.

4. The method of claim 1, wherein the angular positions are four angular positions which are equally spaced at 90°.

5. The method of claim 1, further comprising the following steps for determining the spatial position of the bottom of a borehole section having a known or measured length (l):

associating with the inclinometer a compass able to detect the azimuthal angular orientation of the down-hole assembly;

detecting, in each of said angular positions of the down-hole assembly, the respective value of the azimuthal angle ($Az_0$, $Az_{90}$, $Az_{180}$, $Az_{270}$);

calculating the arithmetic averages ($i_{m1}$, $i_{m2}$) of the inclination values detected in pairs of consecutive angular positions ($I_0$ and $I_{90}$), ($I_{180}$ and $I_{270}$);

calculating the arithmetic averages ($Az_{m1}$, $Az_{m2}$) of the values of azimuthal angles ($Az_0$ and $Az_{90}$), ($Az_{180}$ and $Az_{270}$) detected in said pairs of consecutive angular positions;

relating the length (l) of the borehole section (F) to the values of said arithmetic averages for corresponding pairs of angular positions and calculating, for each pair, the spatial coordinates ($Ox_1$, $Oy_1$; $Ox_2$, $Oy_2$) or offset values of a respective point with respect to a set of three Cartesian axes (x, y, z), the origin of which coincides with the top of the borehole section considered; and calculating, on the basis of the aforementioned coordinates, the spatial coordinates (Ox, Oy) of the bottom of the borehole.

6. The method of claim 5, wherein the spatial coordinates ($Ox_1$, $Oy_1$; $Ox_2$, $Oy_2$) of said points are calculated using the following formulae:

$$Ox_1=1\cdot\sin(i_{m1})\cdot\cos(Az_{m1})$$

$$Ox_2=1\cdot\sin(i_{m2})\cdot\cos(Az_{m2})$$

$$Oy_1=1\cdot\sin(i_{m1})\cdot\sin(Az_{m1})$$

$$Oy_2=1\cdot\sin(i_{m2})\cdot\sin(Az_{m2}).$$

7. The method of claim 6, wherein the spatial coordinates (Ox, Oy) of the bottom of the borehole are obtained by calculating the arithmetic averages of said coordinates ($Ox_1$, $Oy_1$; $Ox_2$, $Oy_2$) using the following formulae:

$$Ox=(Ox_1+Ox_2)/2$$

$$Oy=(Oy_1+Oy_2)/2.$$

8. The method of claim 1, wherein the boring tool is a hydraulic hammer.

9. The method of claim 1, wherein the step e) of causing the boring tool to advance further down is performed imparting to the string rotary reciprocating motions, oscillating about said first axis and about said selected angular position.

10. The method of claim 1, wherein the boring tool is a hydraulic or pneumatic hammer, and wherein the step e) of causing the boring tool to advance further down is performed by causing the hammer to perform percussive motions without rotating the drill string.

11. The method of claim 1, wherein the boring tool is associated with a mud motor, and wherein the step e) of causing the boring tool to advance further is performed by activating the mud motor without rotating the drill string.

* * * * *